US005392025A

United States Patent [19]

Figh et al.

[11] Patent Number: 5,392,025

[45] Date of Patent: Feb. 21, 1995

[54] ELECTRONIC SECURITY SYSTEM FOR DISPLAY CABINETS

[75] Inventors: Jack N. Figh, Guttenberg; Robert V. Cuddihy, Jr., Basking Ridge, both of N.J.; Stanley H. Buchholtz, Manhasset, N.Y.; Tatsuo Rushing, Denville, N.J.

[73] Assignee: Intermark Corporation, New York, N.Y.

[21] Appl. No.: 126,509

[22] Filed: Sep. 24, 1993

[51] Int. Cl.[6] ..... G08B 13/08

[52] U.S. Cl. ..... 340/545; 70/78; 70/264; 70/DIG. 49; 340/547; 340/825.32

[58] Field of Search ..... 340/547, 545, 825.32, 340/825.31; 70/78, 82, 81, 441, 263, 264, DIG. 49; 312/139, 214

[56] References Cited

U.S. PATENT DOCUMENTS

| | | | |
|---|---|---|---|
| Re. 33,960 | 6/1992 | Neuman | 340/547 |
| 2,153,088 | 4/1939 | Knell | 70/264 |
| 4,090,182 | 5/1978 | Young | 340/545 |
| 5,138,299 | 8/1992 | Patten et al. | 340/545 |
| 5,225,825 | 7/1993 | Warren | 70/73 |

*Primary Examiner*—Glen Swann

*Attorney, Agent, or Firm*—Cohen, Pontani, Lieberman, Pavane

[57] ABSTRACT

A display cabinet for storing and displaying merchandise for sale to consumers is provided with one or more doors, each door being locked by a locking mechanism that can be released by a signal from a remotely located, hand-held RF transmitter operated by a store clerk or cashier. Visual and audible alarms are provided for alerting store personnel to forcible entry into the cabinet and for warning store personnel when the cabinet doors have been open for a time period in excess of a predetermined time period.

19 Claims, 8 Drawing Sheets

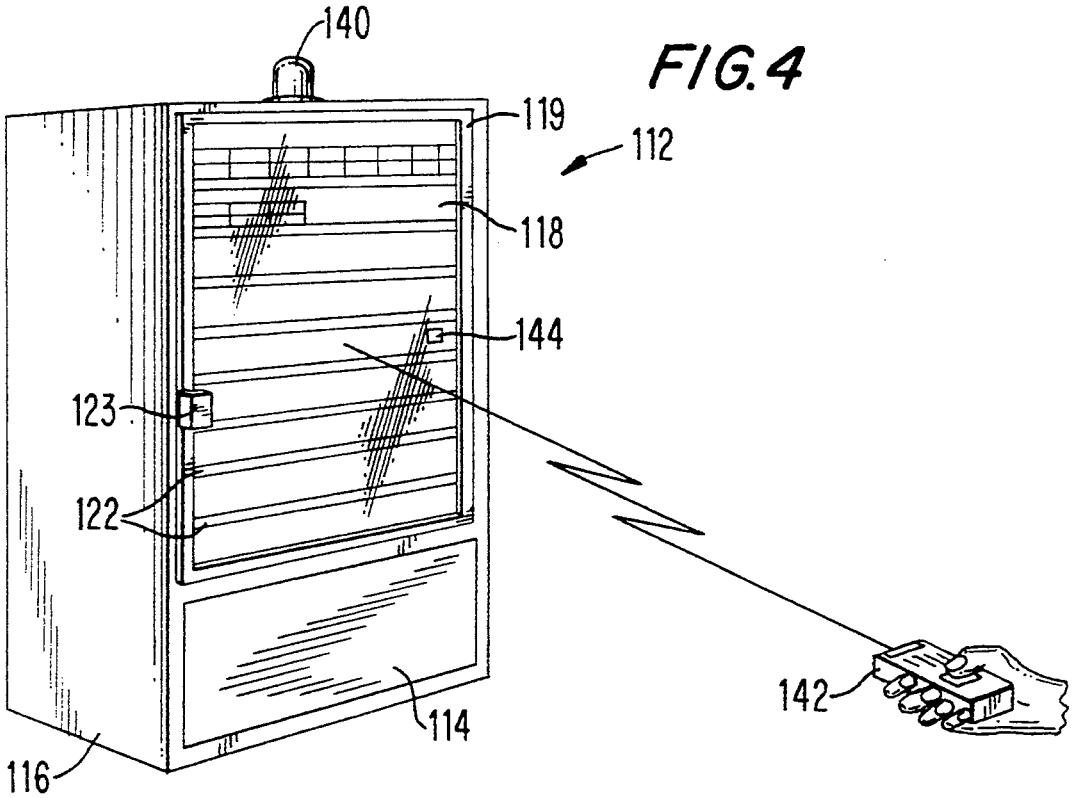
FIG. 4
FIG. 3
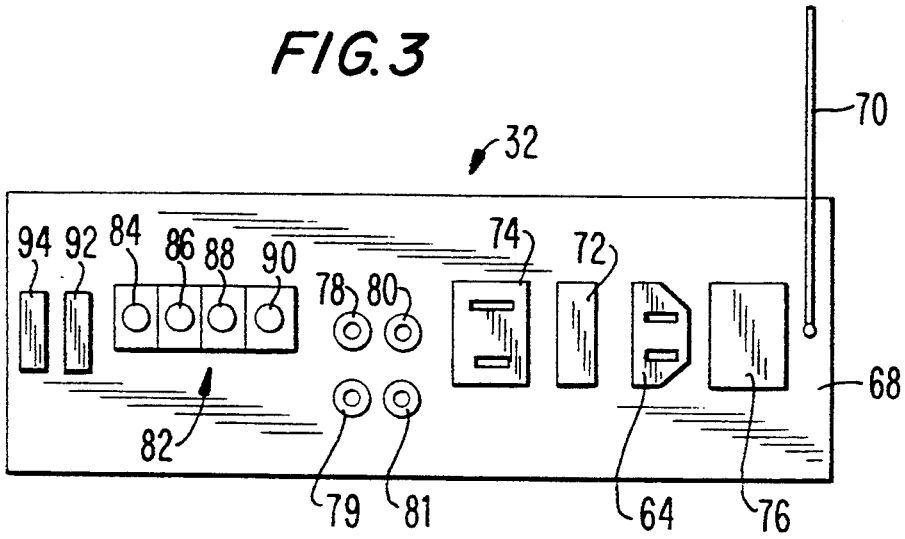

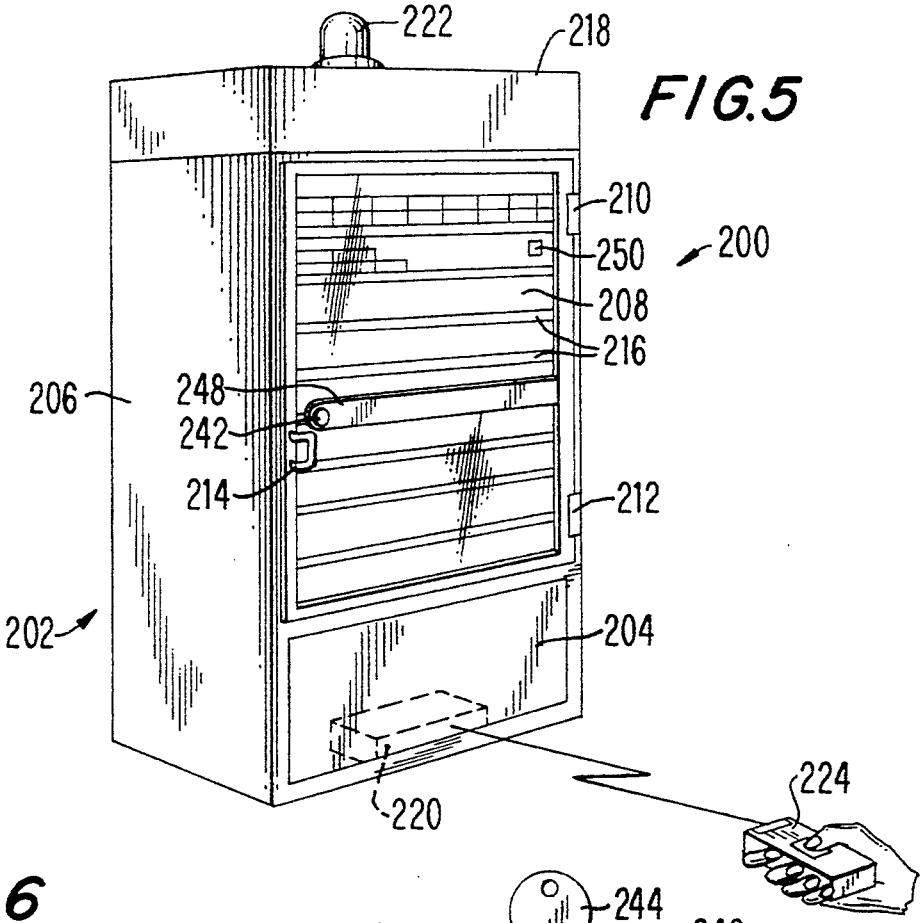
FIG.5
FIG.6
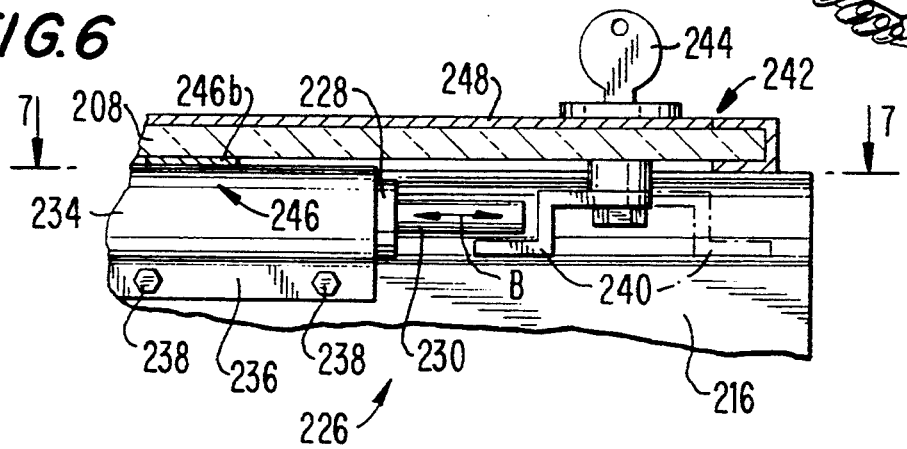
FIG.7
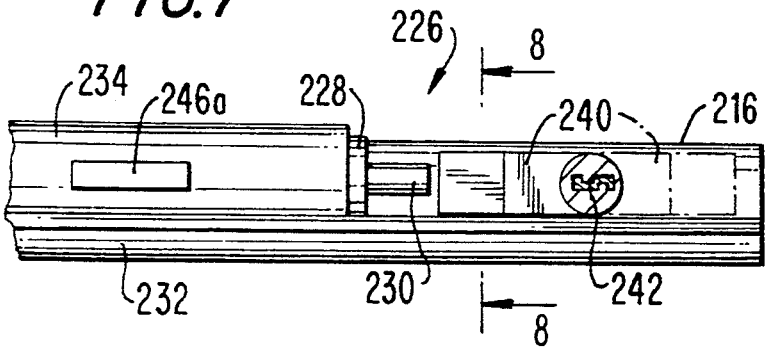

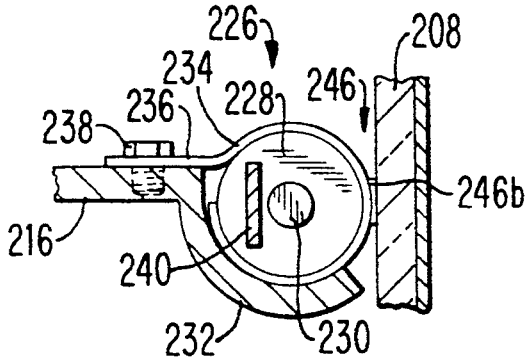
FIG.8
FIG.9
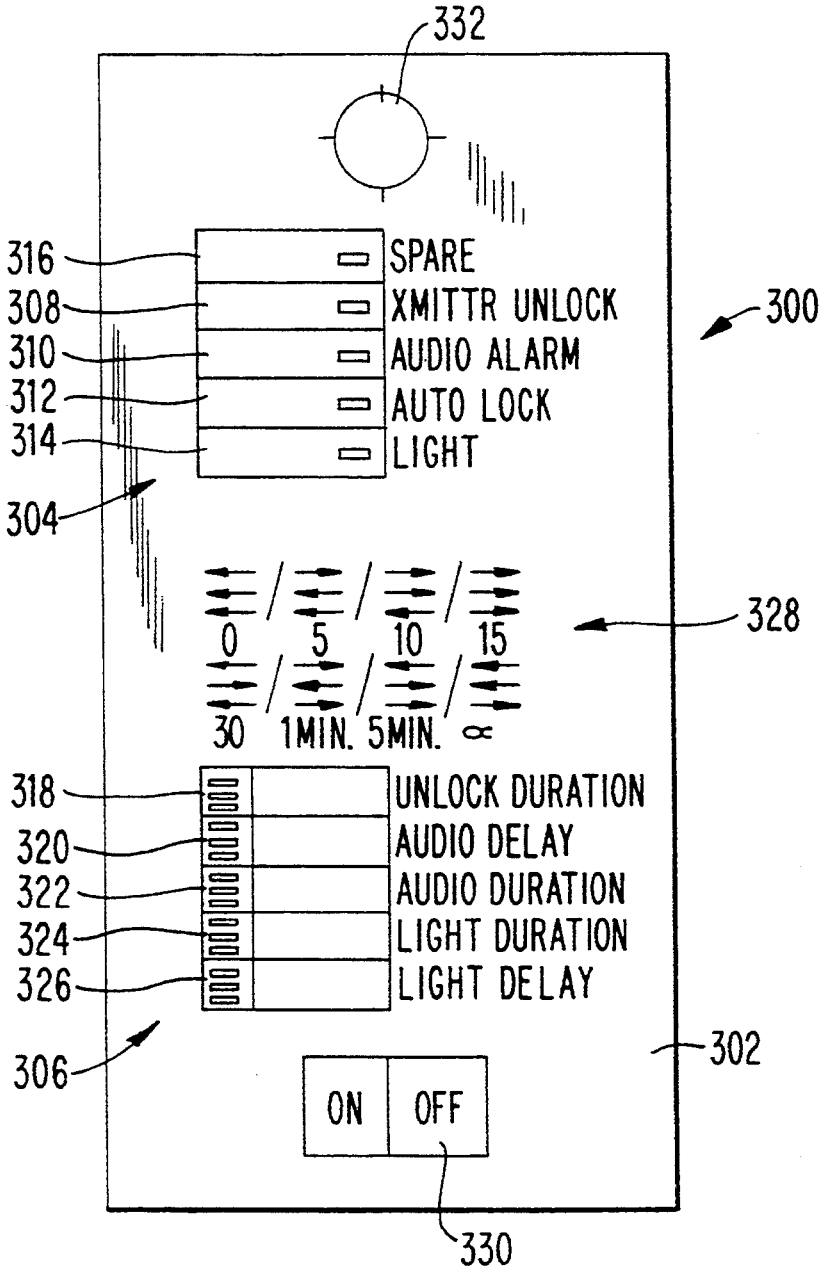

ELECTRONIC SECURITY SYSTEM FOR DISPLAY CABINETS

FIELD OF THE INVENTION

The present invention relates to electronic security systems, and more particularly to an electronic security system for a display cabinet, such as one containing cigarettes.

BACKGROUND OF THE INVENTION

Cigarette display cabinets are widely used in convenience stores, supermarkets, drug stores, discount stores and similar "serve yourself" stores and point-of-purchase locations to hold and display cigarette packages and cartons available for sale. Typically, such cabinets comprise a generally rectangular enclosure having a plurality of horizontal shelves mounted therein for supporting stacks of cigarette cartons. Sometimes one or more transparent doors are provided for the cabinet to allow the purchaser to view and access the contents of the cabinet.

A key feature of any cigarette cabinet is its security system. Cigarettes have become increasingly expensive, largely due to rising excise taxes imposed by federal and state governments. As a result, several hundred cigarette cartons represent a valuable inventory of several thousand dollars. Accordingly, cigarettes are increasingly a target of thieves, especially shoplifters. In order to safeguard cigarette display cabinets from pilfering by shoplifters, a variety of locking devices have been used to secure the cabinets. However, when a store is busy or short on personnel, it is time-consuming and frequently inconvenient and distracting for a clerk or salesperson to locate the key to the lock, walk to the cigarette cabinet, which may be located in another part of the store, unlock the cabinet, wait until the patron selects his merchandise, and then relock the cabinet and return to his work station. This practice is especially difficult in many stores, such as convenience stores, which ordinarily have only one cashier who must leave the cash register unattended to unlock the cigarette cabinet, thereby inconveniencing waiting patrons and, at the same time, jeopardizing the security of the cash register. It would be desirable, therefore, to provide a locking cigarette cabinet which is both secure against pilfering and convenient to operate.

SUMMARY OF THE INVENTION

The present invention is directed to a security system for a cigarette cabinet having a remotely operated locking system which allows a cashier or salesperson to unlock the cabinet from any location in the store. The system is also advantageously provided with several built-in anti-theft features for discouraging shoplifters.

The security system is adapted to be installed in newly manufactured cabinets as well as retrofitted to existing cigarette cabinets. Such cabinets comprise a generally rectangular enclosure having a plurality of horizontal shelves on which stacks of cartons or packages of cigarettes may be placed. These cabinets are typically provided with one or a pair of transparent doors which open to allow access to the compartment containing the cigarette cartons or packs.

The security system of the invention comprises an electronically-controlled locking mechanism for locking the doors closed, audible and visual alarm systems, and at least one hand-held, battery-powered transmitter with a cooperating receiver located in an electronic control module at the cabinet to allow the cashier to unlock the cabinet from anywhere in the store. Additionally, in the case of two-door cabinets, the security system provides means for preventing both doors of the cabinet from being opened simultaneously. The electronic security system is also programmable by the store operator or manager to meet the special needs and requirements of each individual store. For example, a programmable electronic timer is provided for activating the visual and/or audible alarm after a door has been open for a predetermined period of time. The initiation of one of the two alarms is also programmable independently of the other alarm.

When the system is in its operating mode, the locking mechanism prevents the doors from opening. If a door is forcibly opened, both the visual and audible alarms are immediately activated, thereby alerting store personnel and discouraging the thief. The security system is temporarily deactivated by depressing a deactivation button or operating a deactivation switch on the hand-held remote transmitter which transmits a radio frequency (RF) signal in a conventional manner to a receiver. The receiver, in turn, generates an electrical signal in response to the RF signal to disengage or release the locking mechanism and energize the alarm circuits which are set to activate the visual and audible alarms after a predetermined, programmable time delay. The time delay period for activating the alarms can be varied to suit the store manager and is preferably set to allow the average consumer sufficient time to remove one or several cigarette cartons from the cabinet, but not enough time to allow a thief to remove a large quantity of cigarette cartons from the cabinet without arousing suspicion. An additional safeguard against theft is provided by an "autolock" feature. Briefly, this feature, also controlled by the electronic control module at the cabinet, allows only one door of a multi-door cabinet to be opened at one time.

A key advantage of the security system of the present invention is the provision of a secure cigarette cabinet having a locking mechanism and an alarm system that a cashier or salesperson can disengage and temporarily deactivate from any remote location in the store without having to leave his work station, such as a cash register, unattended.

Yet another advantage of the security system of the present invention is that the store personnel need not actually observe the customer removing cigarette cartons from the cabinet, inasmuch as the time delay alarm warns of potential looting of the cabinet contents.

Still another advantage of the security system of the present invention is that when the customer closes the opened cabinet door, the cabinet door is automatically relocked, the alarm timer circuit is disabled, and the normal door alarm system is reactivated.

With the foregoing and other objects, advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 3 is an elevation view of the electronic control module showing the various components and connections for the security system of the present invention;

FIG. 4 is an environmental perspective view of another embodiment of the cigarette cabinet electronic security system and remote control transmitter of the present invention;

FIG. 5 is an environmental perspective view of another embodiment of the cigarette cabinet electronic security system and remote control transmitter of the invention especially adapted for retrofitting a conventional cigarette display cabinet;

FIG. 6 is an enlarged top view detail of the latching mechanism of the FIG. 5 embodiment of the invention with the latching mechanism engaged;

FIG. 7 is an enlarged front view detail of the latching mechanism of FIG. 6 taken along line 7—7 of FIG. 6 with the latching mechanism disengaged;

FIG. 8 is a cross-sectional detail taken along fine 8—8 of FIG. 7; and

FIG. 9 is an elevation view of another embodiment of the electronic control module showing alternate means for controlling the security system of the invention.

DETAILED DESCRIPTION OF THE PREFERRED EMBODIMENT

Figure 1:
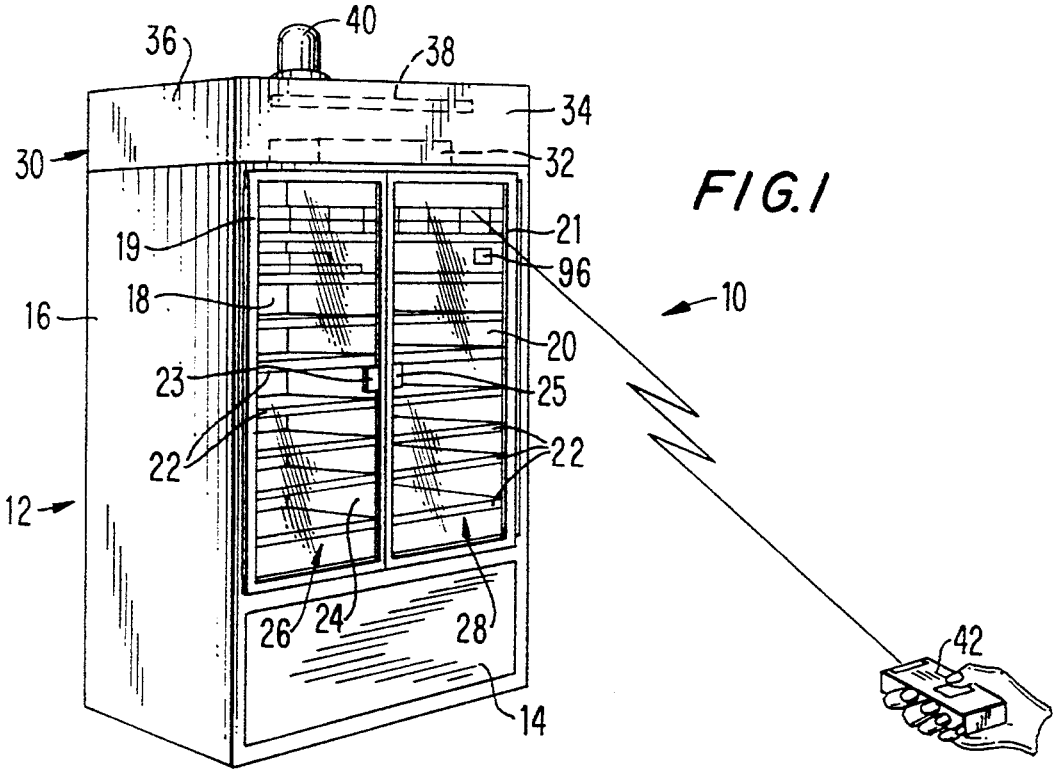
FIG. 1 is an environmental perspective view of one embodiment of the cigarette cabinet electronic security system and remote control transmitter of the present invention.

Referring now in detail to the drawings wherein like parts are designated by like reference numerals throughout, there is illustrated in FIG. 1 an environmental perspective view of a cigarette cabinet security system of the present invention referred to generally by reference numeral 10. The security system may be installed in newly manufactured cigarette cabinets or retrofitted to existing cigarette cabinets.

The system 10 includes a cabinet 12 and a generally rectangular enclosure 16. The enclosure 16 is closed in front by a pair of transparent doors 18, 20 which are hinged at their outermost sides 19, 21 so as to swing open from the center of the cabinet, thus permitting access to the cabinet contents. Handles 23, 25 are mounted to a respective door 18, 20 so that a customer may conveniently open a door. The internal space of the enclosure 16 is provided with a plurality of horizontal shelves 22 and, preferably, a vertical divider partition 24. Partition 24 separates the enclosure 16 into two shelved compartments 26, 28, each such compartment being accessible only from a respective one of the doors 18, 20.

A housing 30 is mounted on top of cabinet 12 and houses an electronic control module 32 for the security system which will be described hereinafter in greater detail. The housing 30 may also serve as a lighted sign with advertising indicia located on the front panel 34 and side panels 36 (only one shown). One or a plurality of fluorescent or incandescent lights 38 may be mounted behind one or more of the panels 34, 36 which are preferably translucent for this purpose. The lights 38 may be connected in the security system visual alarm circuit and/or a separate visual alarm light 40 may be provided on top of the housing 30, or at a location remote from the cigarette cabinet, such as at a cash register, the store manager's office, or the like.

The electronic control module 32 includes a radio frequency (RF) receiver similar to the type used in automatic garage door openers and other conventional RF remote controlled devices. As is well known, conventional RF receivers are used to effect operation or activation of electrical signals to control motors, solenoids and the like when the receiver receives an RF signal transmitted from a hand-held RF transmitter. In the case of the present invention, an electrical signal is generated by the RF receiver when it receives an RF signal transmitted by a conventional portable battery-powered transmitter 42 adapted to be carded by a clerk or cashier in a store in which the present invention is located.

Figure 2:
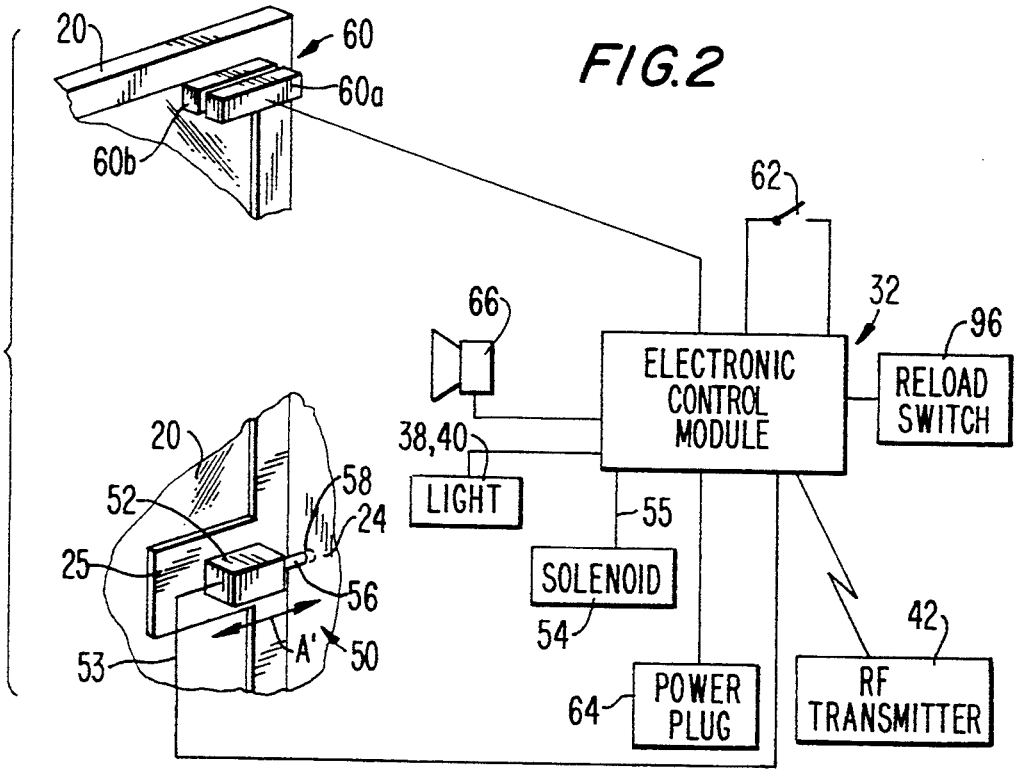
FIG. 2 is a schematic diagram of the security system of the present invention.

Referring now to FIGS. 2 and 3, the electronic security system of the invention will now be described. The security system of the invention is controlled by an electronic control module 32 which includes a microprocessor for controlling the various functions of the security system.

Each of the two doors 18, 20 (only door 20 is illustrated in FIG. 2), is provided with a latching or locking mechanism 50 mounted on the inside of door 20 behind the handle 25. Alternatively, the latching mechanism 50 may be mounted on the underside or front of one of the shelves 22 or in any other convenient location inside the cabinet. In the embodiments disclosed in FIGS. 1–4 herein, the latching mechanism 50 comprises a pair of electromagnetic solenoids 52, 54 each of which operates a respective bolt 56 (only one shown) reciprocally in the directions shown by the doubleheaded arrow A so as to engage and disengage an opening 58 in partition wall 24 and thereby lock and unlock, respectively, the doors 18, 20. Any other suitable electrically-controlled locking mechanism may be used. Preferably, the latching mechanism 50 remains in the locked condition upon loss of electrical power to the system 10.

Each door 18, 20 is also provided with a magnetic switch 60, 62 which is closed when the door associated therewith is closed, as is the case with switch 60 and is opened when the door associated therewith is open as is the case with switch 62. Opening of the door 18 or 20 will open the circuit containing the respective magnetic switch 62 or 60 and closing the door will close that circuit. Magnetic switch 60 comprises a switch element 60*a* and a magnet or magnetic strip 60*b* which actuates the switch element 60*a* dosed when it comes in proximity with switch element 60*a*. Other types of switches responsive to the opening and closing of the doors may also be used.

Electronic control module 32 is powered by a conventional 110-volt electrical circuit which is supplied to the module through a standard power plug 64 and which also receives and processes the RF signals. Module 32 operates the solenoids 52, 54, senses the condition of the magnetic switches 60, 62 and controls the operation, including duration and delay times of a visual alarm, which may be a light 38, 40, and an audible alarm 66 which may be a horn, buzzer, siren or the like.

The electronic control module 32 (FIG. 3) comprises a housing 68 for mounting the microprocessor, RF receiver and other electronic connections and controls. An antenna 70 is mounted on the housing 68 for receiving the RF signal transmitted by hand-held RF transmitter 42. A power switch 72 is mounted adjacent power input plug 64 for switching the system on and off. Power receptacle 74 provides conventional 110-volt power for the visual alarm lights 38 and/or 40. The audible alarm 66 may be mounted inside the housing 68 so as to emit sound through a perforated panel 76 or other suitable speaker cover.

Electrical signals to the solenoids 52, 54 are transmitted via electrical wires 53, 55 connected to signal outlets 78, 80 on the housing 68. The magnetic switches 60, 62 are connected to the electronic control module by terminals 79, 81. A panel 82 of adjustment knobs is provided for adjusting the time delay and duration of the visual and audible alarms. A first pair of adjustment knobs 84, 86 is used to adjust the delay and duration, respectively, of the visual alarm lights 38 and/or 40 and a second pair of adjustment knobs 88, 90 is used to adjust the delay and duration, respectively, of the audible alarm 66.

Additional function switches 92, 94 are provided for enhancing the versatility and flexibility of the security system. Switch 92 controls the condition of the visual alarm lights 38 and/or 40, i.e., normally on/flashing for alarm or normally off/flashing for alarm. Switch 94 controls an "autolock" feature which may optionally be used as a further security measure and which will be described below in connection with the description of operation of the security system of the invention.

A restock switch 96 is mounted on the electronic control module 32 or to an inside wall of the cabinet 12 (FIG. 1) for disabling or overriding the alarm circuits when it is desired to restock the cigarette cabinet with product without shutting off power to the control module and display lights. Preferably, the restock switch 96 is located in an unobtrusive position so that its location is known only to store personnel.

The electronic control module 32 and its microprocessor control the operation of the security system in the following manner. Set up of the system requires that the various electrical connections be made to the control module 32 including the setting of the time delay and duration knobs 84–90 for the visual and audible alarms. Although initial settings will usually be made by the manufacturer, the store manager may reset time delay and duration to suit his needs. A typical time delay setting of the knobs 84, 88 for both the visual and audible alarms is 15 seconds, that is, fifteen seconds after one of the doors 18, 20 has been opened as detected by a magnetic switch 60, 62, the visual and audible alarms will be activated. A typical time duration setting of the knobs 86, 90 is one minute, that is, the alarms will continue in operation for one minute following activation. Of course, the knobs 84–90 may be independently adjusted to any other settings as desired by the store manager.

If the "autolock" feature is placed in operation by operating switch 94, only a first one of the two doors 18, 20 may be opened. The other or second door will be automatically relocked upon the opening of the first door. This security feature exposes only half the cigarette inventory to the customer at any one time. The "autolock" feature may be disabled with switch 94.

Under normal conditions, the doors 18, 20 of cabinet 12 are locked by locking mechanisms 50, the advertising display lights 38 and/or light 40 are on or off (depending on the condition of the switch 92) and the magnetic switches 60, 62 are closed. If one or both of the doors 18, 20 is forcibly opened, e.g., by a thief, one or both of the magnetic switches 60, 62 will be opened. Since neither solenoid 52, 54 has been operated to the unlocked or unlatched position, opening of one of the switches 60, 62 will immediately activate the audible alarm 66 and the visual alarm lights 38 and/or 40. In the case of visual alarm light 38, the operation of that light may be switched from off or continuously on to intermittent or flashing, again depending on the position of switch 92.

When a customer requests that the cigarette cabinet be opened, the store clerk or cashier takes up the hand-held transmitter 42, points it in the general direction of the cigarette cabinet 12 and depresses the button or switch on the transmitter. The RF receiver in the electronic control module 32 receives the transmitted RF signal via antenna 70 and generates an electrical output to the microprocessor which, in turn, initiates an electrical signal to operate the solenoids 52, 54 to unlatch the locking mechanisms 50 for both doors 18, 20 to allow the customer access to the contents of the cabinet compartments 26, 28.

If the "autolock" feature is in operation, as soon as one of the doors, e.g., door 20, is opened, the magnetic switch for the opened door (switch 60) senses such opening and the "autolock" circuit interrupts the signal to the solenoid for the other door, in this case solenoid 54 for door 18, thereby relocking door 18. In this way, only one of the two doors 18, 20 may be open at any time when the "autolock" feature is operating. If the "autolock" feature is disabled by switch 94, either or both doors 18, 20 may be opened when the solenoids 52, 54 are energized.

Assuming the time delays and durations for the alarms are set as described above, if the opened door, e.g., door 20, remains open for at least 15 seconds, the audible alarm 66 will sound and the visual alarm lights 38 and/or 40 will begin flashing from a lights on or lights off condition (depending on the setting of switch 92). Both alarms will continue operating for a one minute period and will then be shut off, unless during the one minute period the door 20 is closed to disable the alarms.

If the door 20 is closed after opening within the 15 second time delay period, the visual and audible alarms are not energized. Closure of the door 20 is sensed by the magnetic switch 60 which, in turn, interrupts the electrical signal to the solenoid 52 to thereby relock the door.

FIG. 4 illustrates an alternate embodiment of a cigarette cabinet for the security system of the invention designated generally by reference numeral 112. In this embodiment, the cabinet enclosure 116 is provided with only a single transparent door 118 which is hinged along side 119. Handle 123 is used to open door 118 and a latching mechanism (not shown) substantially the same as the latching mechanism 50 in FIG. 2 is provided for locking the door 118. The cabinet enclosure 116 is provided with a plurality of shelves 122 adapted to support stacks of cigarette cartons or packs.

An electronic control module of the same construction as module 32 is mounted in base 114 or in the rear of one of the shelves 122 and controls an audible alarm (not shown) and a visual alarm, such as a light 140, mounted atop enclosure 116. As those skilled in the art will appreciate, the module 32 can also be used to control the security system for the single door cigarette cabinet of the alternate embodiment. Since only one locking mechanism is necessary, the "autolock" feature is not used and only one of the outlets 78, 80 for the solenoids and only one of the terminals 79, 81 for the magnetic switches are used for the respective locking solenoid and magnetic door switch of the cabinet 112. If desired, of course, a lighted advertising display similar to the display 30 may be mounted on top of the cabinet 112 to house the control module and alarm lights. A hand-held RF transmitter 142 is also used to operate the security system of the alternate embodiment and a restock switch 144 is used to disable the alarm systems when restocking the shelves 122.

Referring now to the embodiment of the invention shown in FIGS. 5–8, a cigarette cabinet security system 200 is shown as a retrofit to a conventional cigarette cabinet 202. Cabinet 202 has a base 204 and a generally rectangular enclosure 206. The enclosure 206 is closed in front by a transparent door 208 which is hinged at 210, 212 so as to swing open from left to right as viewed in FIG. 5 to permit access to the contents of the cabinet. A handle 214 is mounted to the door 208 for permitting convenient access to a customer. The internal space of the enclosure 206 is provided with a plurality of horizontal shelves 216 upon which the product, e.g., cigarette cartons, is stacked.

A housing 218 is mounted on top of the enclosure 206 and may serve as a lighted sign with advertising indicia located on the planar panels thereof in the manner described above in connection with FIG. 1.

An electronic control module 220 is mounted inside the base 204 of the cabinet 202 and performs the same functions as described above in connection with electronic control module 32. Module 220 may also be mounted in the housing 218 if desired. An alarm light 222 is mounted atop housing 218 and may be connected with the lights of the lighted sign of housing 218 as in the above-described first embodiment of the invention.

The electronic control module 220 includes a RF receiver which generates electrical signals for operating the security system in response to RF signals transmitted by a hand-held, battery-powered RF transmitter 224. Operation of the security system 200 is substantially the same as the operation of the single door system 112 of FIG. 4.

An important aspect of the embodiment of the invention shown in FIGS. 5–8 is the ease with which existing cigarette cabinets can be retrofitted with the security system of the present invention. Referring to FIGS. 6–8, there is shown a latching or locking mechanism 226 for the door 208. Latching mechanism 226 comprises an electromagnetic solenoid 228 similar to solenoids 52, 54, the plunger of which operates a bolt 230 reciprocally in the directions shown by the arrow B in FIG. 6. Solenoid 228 is mounted in an arcuate lip 232 disposed along the front edge of the conventional shelf 216 by means of a tubular bracket 234. Bracket 234 has a flange 236 which is bolted to shelf 216 by bolts 238.

Latching mechanism 226 further comprises a latching arm 240 mounted to door 208 by a key actuator 242. Key actuator 242 is operable by a key 244 to position the latching arm 240 in one of two positions, a first position shown in solid lines in FIGS. 6 and 7 and a second position shown in dashed lines in FIGS. 6 and 7. The first position of the latching arm 240 is the normal operating position and the second position is the system disable/reload position of the arm 240. Referring to FIG. 6 in which the bolt 230 is shown in its extended or latched position, the door 208 is prevented from being opened, i.e., being pulled away from shelf 216, by the engagement of the latching arm 240 behind the extended bolt 230. When the solenoid 228 is activated by the electronic control module 220 to retract the bolt 230 to the position shown in FIG. 7, the latching arm 240 is free of the bolt 230 and the door 208 may be swung outwardly away from the shelves 216 to provide access to the contents of the enclosure 206.

If it is desired to disable the security system 200 temporarily, for example, to gain access to the cabinet in the event of power loss (upon loss of power the bolt 230 remains extended), or to gain access to the cabinet in the event the hand-held transmitter 224 is lost, misplaced or not readily available or for any other reason, the key 244 is inserted in the key actuator 242 and rotated to position the latching arm 240 in its dashed line position shown in FIG. 6. In this position, the latching arm 240 is free of the extended bolt 230 thereby disabling the latching mechanism 226 and permitting the door 208 to be opened without activating the alarm systems.

It will be appreciated that in the embodiment of FIGS. 5–8 the solenoid 228 is mounted to the shelf 216 whereas in the embodiments of FIGS. 1–4, the solenoids 52, 54 are mounted to the doors. The arrangement of FIGS. 5–8 is, therefore, advantageous since the electrical wiring to the solenoid does not have to transit between the fixed cabinet and the movable door.

A magnetic switch 246 comprising a switch element **246*a* and a magnetic strip 246*b* is provided for sensing the open or closed condition of the door 208 in the same manner as switches 60, 62 of the first embodiment. In this embodiment, however, the magnetic switch element 246*a* is mounted to the solenoid bracket 234 on the side thereof confronting the door 208 (FIG. 7). The magnetic strip 246*b* which actuates the switch element 246*a* is mounted to the rear surface of door 208 (FIGS. 6 and 8). Preferably, an opaque strip 248 of metal or plastic is mounted to the front surface of the door 208 as shown in FIG. 5 to conceal the latching mechanism 226 and magnetic switch 246. Key actuator 242 preferably extends through strip 248 as shown in FIG. 5**.

A restock switch 250 is mounted inside the cabinet enclosure 206 and operates in the same manner as reload switch 96 of the embodiment of FIGS. 1–3 for restocking the contents of the cabinet.

FIG. 9 illustrates another arrangement for adjusting the time delay and duration of the visual and audible alarms and for controlling the various functions of the system. This arrangement may be utilized for any of the embodiments of the invention in lieu of the adjustment panel 82 and switches 92, 94 of the control module 32 of FIG. 3. Similarly, the electronic control module 300 of FIG. 9 may be used as the control module for any of the disclosed embodiments of the security system of the invention.

Module 300 comprises a housing 302 on one side of which there are mounted two switch panels 304, 306 each containing a plurality of DIP (dual in-line package) switches or the like for controlling the various system functions. Switch panel 304 includes on/off switches 308, 310, 312, 314 for deactivating the alarm, setting the audio alarm, activating the autolock feature and the lights or visual alarms, respectively. Switch 316 is a spare. The "Transmitter Unlock" feature is associated with switch 308 to deactivate the alarm for purposes of restocking the cabinet with products without triggering the alarm. If this switch 308 is in the ON position and the control module receives a continuous uninterrupted signal from the remote control RF transmitter 142 for a fixed time period, say fifteen seconds, the system will be disabled and all doors unlocked to permit restocking of the cabinet just as if the Restock Switch (96, 144, 250) had been pressed. The system may then be reactivated either (a) by pressing the remote control RF transmitter 142, (b) by pressing the Restock Switch (96, 144, 250), or (c) automatically after 1 hour. If the "Transmitter Unlock" switch 308 is in the OFF position, this continuous uninterrupted signal for a fixed time period from the remote control is ignored in terms of it being treated as a request to "restock". So, in other words, the "Transmitter Unlock" switch 308 setting determines whether or not the 15 second "Restocking Unlock" feature is to be enabled.

When restocking of the cabinet is necessary, store personnel open the cabinet door or doors and actuate the restock switch 96, 144, 250 to disable the visual and audio alarm circuits. After restocking, and in the event that the store personnel forget or fail to reset the restock switch to reactivate the alarm systems, the electronic control module 300 will automatically reset the restock switch and re-enable the security system after the one hour time duration elapses.

Switch panel 306 includes a series of five individual switch devices 318, 320, 322, 324, 326 each having three two-position DIP switches which may be set to various positions corresponding to a time duration or time delay for a particular security system function. For example, if it is desired to set the time duration of the audio alarm, the three DIP switches of switch device 322 are positioned in one of the eight switch combinations or codes shown in the chart 328. For an audio alarm time duration of fifteen seconds, all three DIP switches of switch device 322 would be shifted to the right as viewed in FIG. 9. It will be appreciated that the time duration and delay periods for the switches 318–326 may be set for periods other than those shown in chart 328.

The "UNLOCK DURATION" switch 318 controls the amount of time that the doors will remain unlocked after the remote control signal is received before automatically relocking. In other words, the "Unlock Duration" controls the amount of time that the consumer has to open the door and select a product. If any one of the doors is opened during this time period, all other doors will be locked (of course, the "autolock" feature for double doors changes this notion slightly). If the system does not detect the opening of any door during the "Unlock Duration" time, the system will reactivate and lock all doors.

The housing 302 preferably contains all other elements of the control module 300, including the power switch 330, and audio alarm volume control 332, as well as the power plugs, light plug-in, etc. The restock switch 96, 144, 250 may also be mounted on the housing 302 rather than on the cabinet enclosure.

Figure 10:
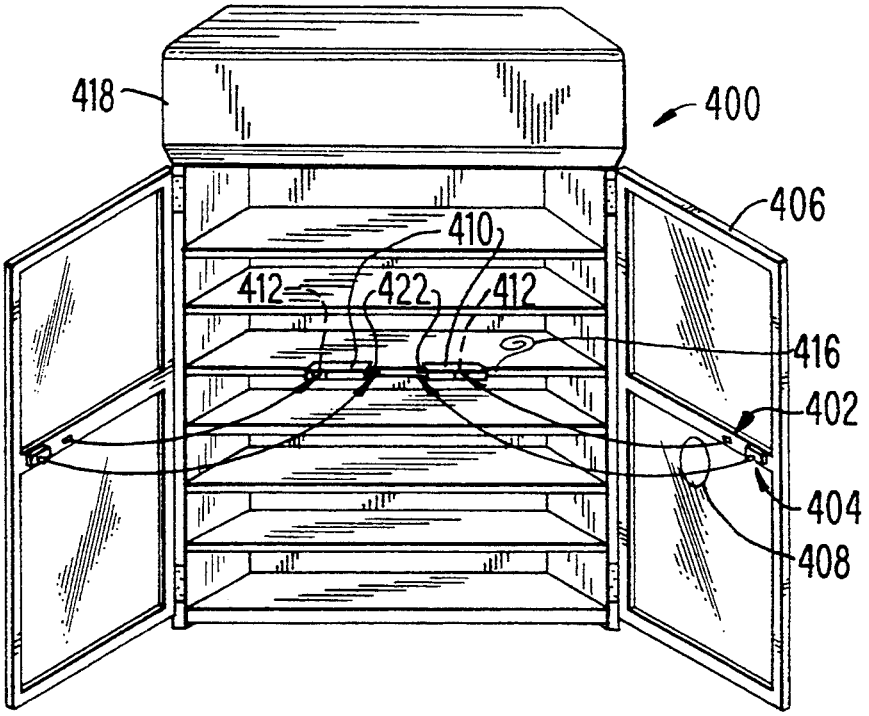
FIG. 10 is a perspective view of a cabinet containing the security system of the invention used in conjunction with the control module of FIG. 9.

FIG. 10 shows a cabinet 400 with a magnetic sensor 402 and striker assembly 404 mounted onto a respective one of the cabinet doors 406. Each sensor 402 and striker assembly 404 is positioned to align, as indicated with the arrows 408, with appropriate counterparts situated on a bracket 410 that is secured to an appropriate one of the cabinet shelves. These counterparts include a magnetically attractive element 412 and the solenoid pin 422 of a solenoid assembly. A wire harness 416 extends from the solenoid assemblies and is in electrical connection with an electronic control module (shown in FIG. 16) enclosed in the top compartment 418 of the cabinet. The bracket 410 may have an L-shaped cross-section.

Figure 11:
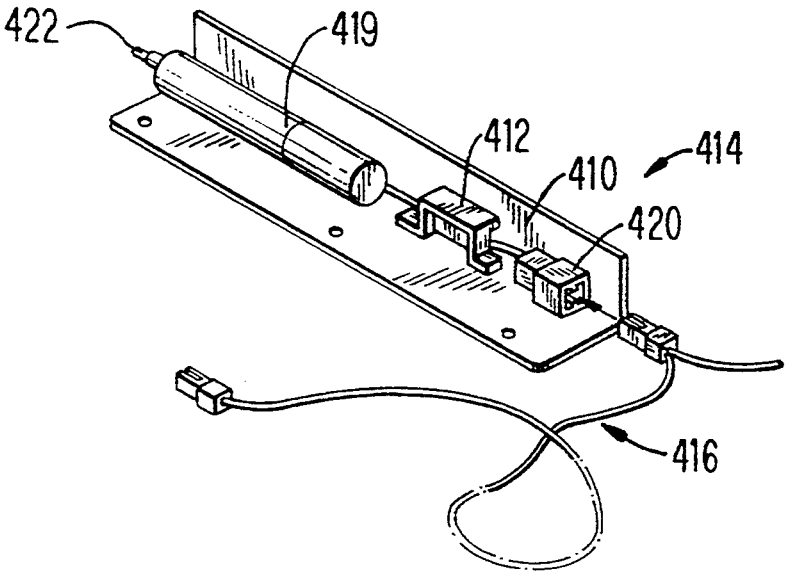
FIG. 11 is an enlarged perspective view of a solenoid assembly in accordance with the embodiment of FIG. 10.
Figure 12:
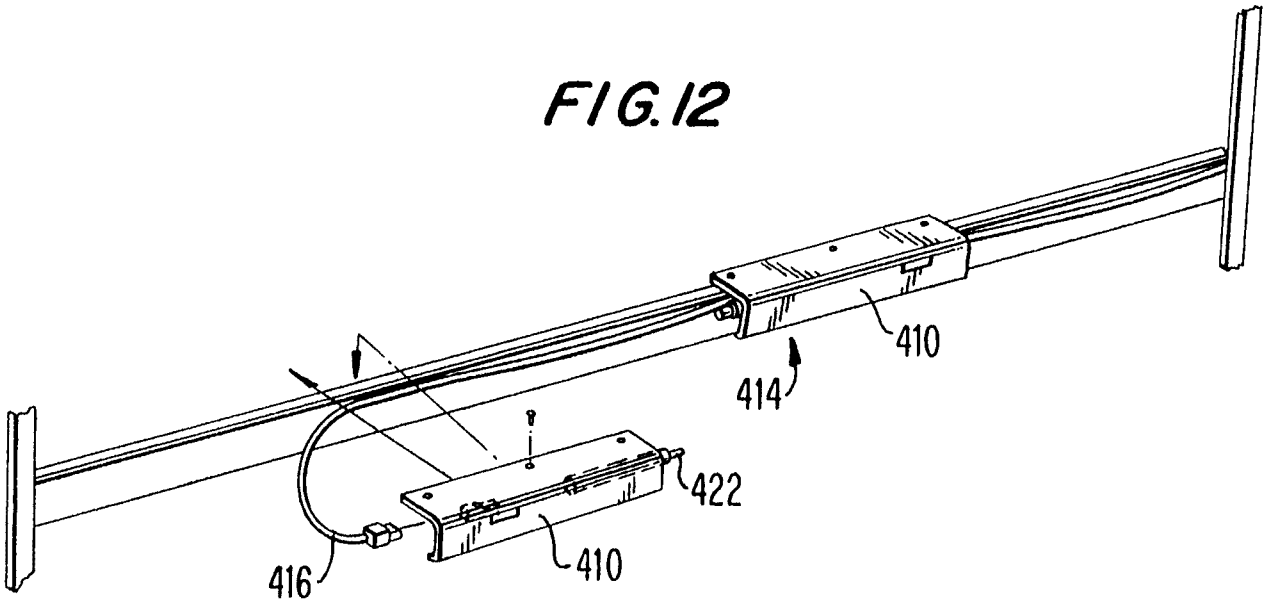
FIG. 12 is an enlarged perspective view of the solenoid assembly as in FIG. 11 positioned on a shelf of FIG. 10.

FIG. 11 shows the right solenoid assembly 414 which includes the bracket 410 holding a solenoid 419 with solenoid pin 422, a magnetically attractive element 412, and a socket 420 which is electrically connected with a plug from the wire harness 416. FIG. 12 shows the right solenoid assembly 414 and its counterpart left solenoid assembly being secured to a front edge of a cabinet shelf. Each solenoid assembly is associated with a respective one of the left and right cabinet doors. The solenoid pins 422 are seen protruding outwardly toward each other from beneath the respective one of the brackets 410. The wire harness 416 is shown extending along the length of the front edge of the cabinet shelf.

Figure 13:
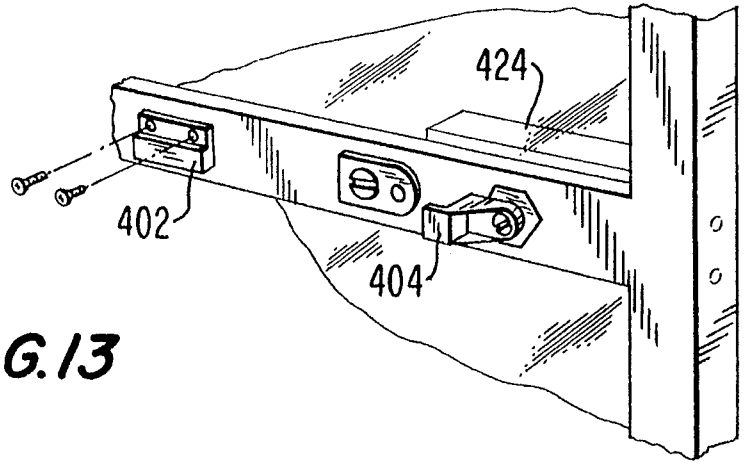
FIG. 13 is an enlarged perspective view of the magnetic sensor/striker assembly in accordance with the invention.
Figure 14:
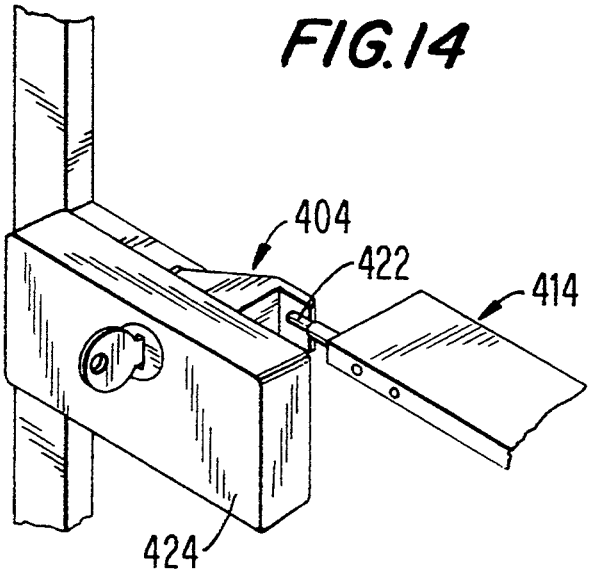
FIG. 14 is an enlarged perspective view of the locking mechanism, striker and solenoid assembly of FIGS. 12 and 13.
Figure 15:
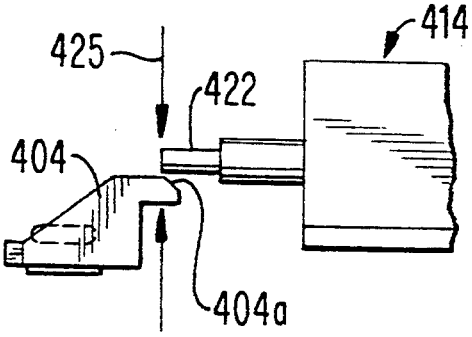
FIG. 15 is a partial top view of FIG. 14.

FIG. 13, on the other hand, shows the striker 404 and magnetic sensor 402 secured to the inside of one of the cabinet doors. The conventional manual key-lock assembly 424 is on the outside of the door. FIGS. 14 and 15 show the relative relationship between the solenoid pin 422 and the striker 404 in the locked condition (FIG. 14) and the unlocked condition (FIG. 15). FIG. 15 shows direction arrows 425 which indicate how alignment is effected. The solenoid pin resiliently biases into the extended position; it retracts in response to being struck by the striker 404 during closure of the cabinet door. A surface **404*a* of the striker that faces the solenoid pin 422 in FIG. 15 inclines to facilitate retraction of the solenoid pin 422 during closure. Preferably, the wires extending between the right and left solenoid assemblies are retained underneath a false shelf front edge cover. Such a cover is preferably also provided to extend from either side of the right and left solenoid assemblies to the side vertical columns of the cabinet to hide the extension of the wiring harness 16** underneath.

Figure 16:
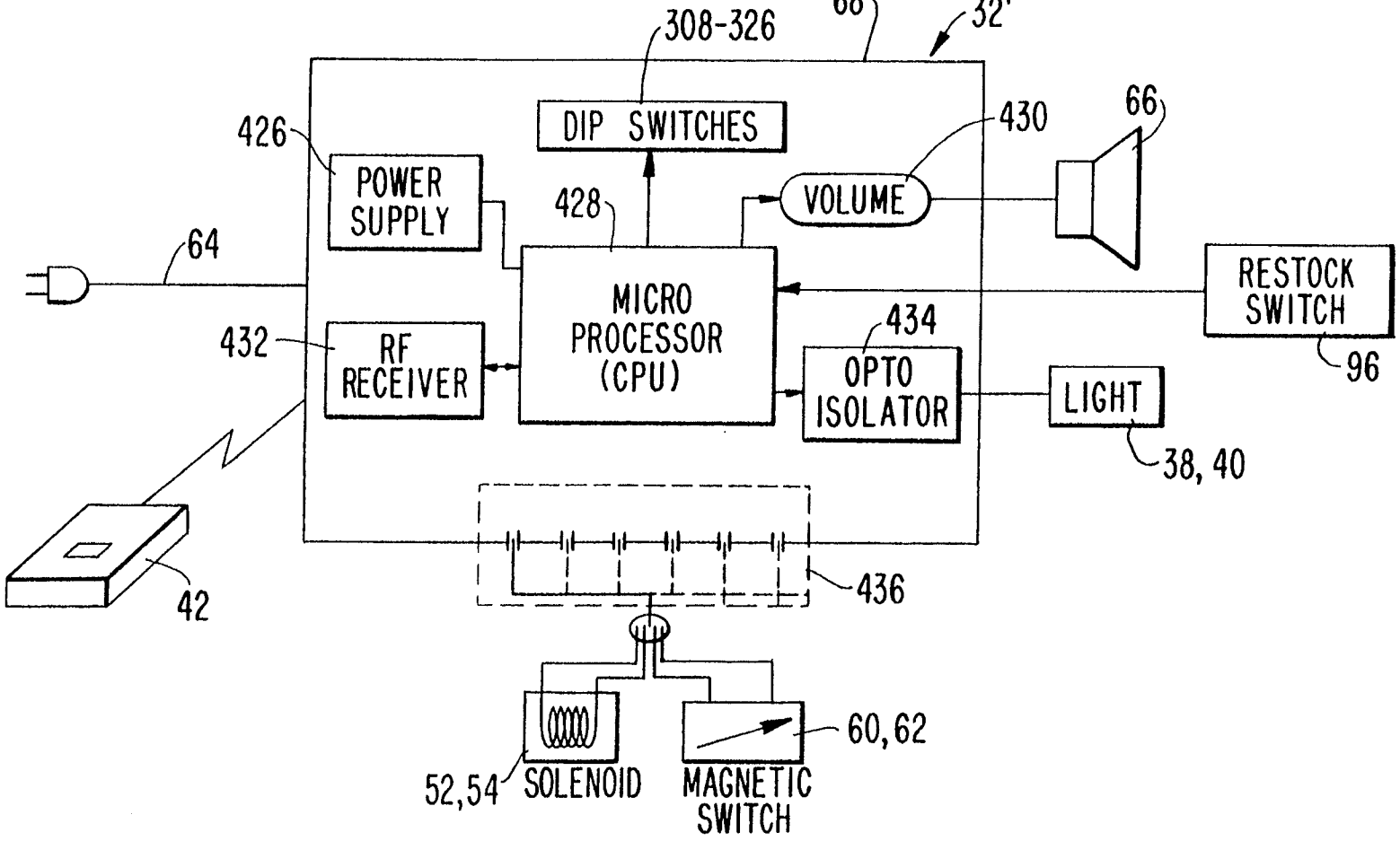
FIG. 16 is a schematic diagram of the security system in accordance with the present invention of FIGS. 9–15.

FIG. 16 shows an electronic control module 32' which includes a power supply circuitry 426 powered through an external power input plug 64, a microprocessor 428 such as that of Motorola MC68HC705C8, a volume control 430 for controlling the enunciation level of the buzzer 66, an RF receiver 432, an optoisolator 434 for isolating the voltage of the light 38, 40 from the microprocessor 428, ports 436 for connection with solenoids 52, 54 and magnetic switches 60, 62, and DIP switches 308–326 (see FIG. 9). The remote transmitter 42 communicates with the RF receiver 432. A reload switch 96, when actuated, overrides the alarm system to allow for restocking of the shelves without triggering the buzzer or light of the alarm system. There are six ports 436 which exemplify connection locations for servicing up to six separate solenoid/magnetic switch units (e.g., six single door cabinets or six double door cabinets). A double door cabinet has only one plug and requires only one port. The microprocessor 428 processes signals from RF receiver 432 to instruct the solenoids 52, 54 accordingly and responds to signals from the magnetic switches 60, 62 to trigger the buzzer or light as applicable. The settings of the DIP switches 308–326 determine features such as alarm time delay and duration and unlock duration. The reload switch, when actuated, overrides the normal alarm triggering for a longer predetermined time period to permit restocking of the cabinets with products without triggering the alarm.

The embodiment of FIGS. 10–16 may be retrofitted onto an existing cabinet and allow the doors to be unlocked either remotely by the transmitter or manually with the key-lock. This latter feature is important in the event of power failure which disables the transmitter system. The light 38, 40 may be arranged within the top 418 of the cabinet (see FIG. 10); the front of the top may be covered by a translucent material so that illumination from within the top is visible from the outside. Preferably, an advertising sign extends across the front of this top 418 but is not completely opaque. When a cabinet door opens, for instance, this light may flash in accordance with a predetermined sequence to flash the advertising sign as an indication for store personnel that the door is open. It may not be desirable for the buzzer to enunciate adjacent to the cabinet if the public will become disturbed; therefore, such enunciation or other type of alarm may be made remote from the cabinet, such as in the vicinity of store personnel or security normally located elsewhere in the store.

By mounting the solenoid assemblies on the front edge of the cabinet shelf and arranging them so that the solenoid pin biases along the length of the shelf, no shelf space is interfered with by the placement or operation of the assemblies. However, alignment between the solenoid assemblies and the striker and magnetic sensor is required as shown by FIG. 10.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

While the preferred embodiment discusses the invention as being used for a cabinet containing cigarette packages or cartons, the cabinet may contain instead, or in addition, other kinds of products, including such products as cigar boxes, cigarette lighters and other tobacco-related products. Further, the products may instead, or in addition, be other kinds of consumer goods which are typically shelved in a locked display cabinet, such as jewelry and watches. Such goods are typically expensive, lightweight and easy to conceal by a shoplifter because of their small size.

Any type of wireless transmission could be used for remote deactivation of the door locking mechanism, e.g., radio transmitters with RF receivers, light emitters with photodetectors, ultrasonic generators with ultrasound detectors, etc. Whichever wireless transmission is employed, the transmission should be unique and recognizable by the electronic control module (e.g., for a specific duration and frequency and, perhaps, pulsed).

While the foregoing description and drawings represent the preferred embodiments of the present invention, it will be understood that various changes and modifications may be made without departing from the spirit and scope of the present invention.

What is claimed is:

1. A cabinet security system suitable for use with a cabinet having an interior for containing a plurality of products, the cabinet having at least one door, the door being movable between an open position for allowing access to the interior, and a closed position for allowing access to the interior, and a closed position for denying access to the interior, the system comprising:

a locking mechanism for locking the door in the closed position;

electronic means for releasing said locking mechanism, said electronic means being responsive to sensing wireless transmission from a remote location to release said locking mechanism and to thereby permit said door to be moved to the open position for allowing the access to the interior; and indication means responsive to the door's being in one of the open and closed positions for making indication while the door is in said one of the open and closed positions, said indication signifying that the door is in said one of the open and closed positions.

2. The system according to claim 1, wherein said electronic means comprises an RF receiver mounted at said cabinet and a hand-held RF transmitter.

3. The system according to claim 1, wherein said electronic means includes means for sensing the door of said cabinet being forcibly opened while said locking means is locking the door in the closed position, said indication means including an alarm means for generating an alarm in response to said electronic means' sensing that the door of said cabinet is being forcibly opened.

4. The system according to claim 3, wherein said alarm means includes time delay means for generating an alarm in response to said door's remaining open for a period in excess of a first predetermined time period.

5. The system according to claim 4, wherein said alarm means includes at least one of a visual alarm and an audible alarm.

6. The system according to claim 4, wherein said alarm means further includes time duration means for interrupting the generated alarm after a second predetermined time period.

7. The system according to claim 6, further comprising means for adjusting a duration of each of the first and second predetermined time periods of the time delay means and the time duration means.

8. The system according to claim 4, further comprising means for sensing the opening of said door to initiate timing of the first predetermined time period.

9. The system according to claim 8, wherein said sensing means comprises a magnetic switch mounted between said door and said cabinet.

10. The system according to claim 4, wherein said alarm means includes a visual alarm which comprises a light mounted to said cabinet.

11. The system according to claim 10, wherein said light is arranged for illuminating an advertising sign retained by said cabinet.

12. The system according to claim 10 wherein said light is continuously illuminated in response to said alarm means which also causes said light to illuminate intermittently after the expiration of the first predetermined time period.

13. The system according to claim 10 wherein said alarm means causes said light to be off during said first predetermined time period and causes said light to illuminate intermittently after the expiration of the first predetermined time period.

14. The system according to claim 3, wherein said alarm means includes bracket means for mounting components of said alarm means to a shelf of the cabinet and includes means for mounting additional components of said alarm means to a door of the cabinet, further comprising a cover which blocks at least some of said components mounted to the shelf from view.

15. The system according to claim 3, wherein said alarm means includes a solenoid, a biased solenoid pin protruding from said solenoid, and a striker arranged for striking and displacing said solenoid against the bias as the door closes until the striker passes by said solenoid pin, said solenoid pin displacing against said bias also in response to activation of said solenoid.

16. The system according to claim 15, wherein said sensing means includes a magnetic switch mounted between said door and said cabinet, further comprising bracket means for mounting said solenoid, said solenoid pin and said magnetic switch onto a shelf of the cabinet.

17. The system according to claim 1, wherein said interior is divided into a plurality of compartments with a respective door associated with each compartment and a locking mechanism for each door, said electronic means being operative to release the locking mechanism of each door and to relock the locking mechanisms of the other doors when one of said doors is opened.

18. The system according to claim 1, further comprising means for sensing unauthorized access to the interior as a result of the door's being opened, and means for generating an alarm in response to said sensing means' sensing the unauthorized access.

19. The system according to claim 1, wherein said locking mechanism includes an electromagnetic solenoid which, when energized, releases the locking mechanism to permit opening of said door.

* * * * *